US006083610A

United States Patent [19]

Hirose

[11] Patent Number: 6,083,610

[45] Date of Patent: Jul. 4, 2000

[54] THERMAL TRANSFER SHEET

[75] Inventor: Keiji Hirose, Tokyo-To, Japan

[73] Assignee: Dai Nippon Printing Co., Ltd., Japan

[21] Appl. No.: 09/061,861

[22] Filed: Apr. 17, 1998

Related U.S. Application Data

[62] Division of application No. 08/704,858, Aug. 28, 1996, Pat. No. 5,795,656.

[30] Foreign Application Priority Data

Aug. 29, 1995 [JP] Japan ..... 7-243634

[51] Int. Cl.[7] ..... B41M 5/40

[52] U.S. Cl. ..... 428/195; 428/484; 428/488.4; 428/913; 428/914

[58] Field of Search ..... 428/195, 188.1, 428/484, 488.4, 500, 524, 913, 914

[56] References Cited

FOREIGN PATENT DOCUMENTS 0 568 031 11/1993 European Pat. Off. ..... 428/195

2 656 139 6/1991 France ..... 428/195

OTHER PUBLICATIONS

Patent Abstracts of Japan, vol. 14, No. 395 (M–1016), Aug. 27, 1990 & JP–A–02 150391 (General, K.K.), Jun. 8, 1990.

Patent Abstracts of Japan, vol. 17, No. 397 (M–1452), Jul. 26, 1993 & JP–A–05 077561 (Dai Nippon Printing Company Limited), Mar. 30, 1993.

Patent Abstracts of Japan, vol. 15, No. 404 (M–1168), Oct. 15, 1991 & JP–A–03 166992 (Dai Nippon Insatsu Kabushiki Kaisha), Jul. 18, 1991.

Patent Abstracts of Japan, vol. 15, No. 212 (M–1118), May 30, 1991 & Jp–A–03 058888 (General K.K.), Mar. 14, 1991.

*Primary Examiner*—Bruce H. Hess
*Attorney, Agent, or Firm*—Parkhurst & Wendel, L.L.P.

[57] ABSTRACT

There is provided a thermal transfer sheet comprising: a substrate film; and a release layer, a protective layer, and a hot-melt ink layer provided in that order on one side of the substrate film.

2 Claims, 1 Drawing Sheet

THERMAL TRANSFER SHEET

This is a Division of application Ser. No. 08/704,858 filed Aug. 28, 1996, now U.S. Pat. No. 5,795,656.

BACKGROUND OF THE INVENTION

1. Field of the Invention

This invention relates to a thermal transfer sheet which comprises a substrate film and a release layer, a protective layer, and a hot-melt ink layer provided in that order on the substrate film, has excellent thermal transferability, and can provide a thermally transferred print having excellent scratch resistance and heat resistance.

2. Background Art

Various thermal transfer sheets are known in the art, and, in particular, among them are a thermal dye transfer sheet comprising a substrate film bearing a dye layer containing a thermally sublimable dye and a binder and a hot-melt thermal transfer recording sheet comprising a substrate film bearing a hot-melt ink layer containing a colorant, such as a pigment, and a vehicle, such as wax, are known in the art. According to a thermal transfer system using these thermal transfer sheets, various prints can be simply formed with a thermal head or the like. Therefore, in order to conduct the control of film products in factories and the like, the thermal transfer sheets in combination with the thermal transfer system have been used to print bar codes and the like on untreated PET labels and the like for product control purposes. For example, regarding a material and a layer construction for thermal transfer printing on a plastic film, a thermal transfer sheet comprising a substrate film bearing a thermal transfer layer formed of a resin having a softening temperature of 60 to 110° C. and a colorant is known in the art (Japanese Patent Laid-Open No. 163044/1979).

However, when the conventional thermal transfer sheet is used to transfer a thermal transfer layer onto a smooth substrate film, such as an untreated PET film, the transfer per se is unsatisfactory and, at the same time, the transferred thermal transfer layer has poor scratch resistance and heat resistance, making it impossible to use the resultant print for the product control purposes in actual factories and the like. Therefore, the solution to the above problem and the development of a thermal transfer sheet, which has excellent thermal transferability and can provide a print having scratch resistance and heat resistance good enough to be usable for product control purposes in actual factories and the like, have been desired in the art.

SUMMARY OF THE INVENTION

According to the present invention, the above object can be attained by a thermal transfer sheet comprising: a substrate film; and a release layer, a protective layer, and a hot-melt ink layer provided in that order on one side of the substrate film.

According to a preferred embodiment of the present invention, the release layer is formed of a wax, the protective layer is formed of a polymethyl methacrylate resin and the hot-melt ink layer is formed of a mixture of a novolac phenol/formaldehyde polycondensate with a colorant.

According to the thermal transfer sheet of the present invention, a thermal transfer layer (comprising a hot-melt ink layer and a protective layer) can be efficiently transferred onto a smooth surface of a substrate film, such as an untreated PET label, and the image formed by the transfer, which is covered by the protective layer, has good scratch resistance and heat resistance.

DETAILED DESCRIPTION OF THE INVENTION

Figure 1:
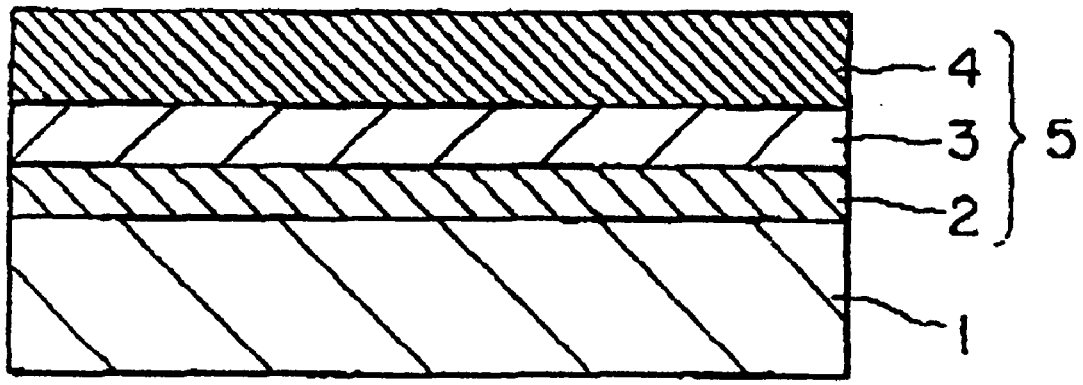
FIG. 1 is an explanatory, schematic cross-sectional view of one embodiment of the thermal transfer sheet according to the present invention.
Figure 2:
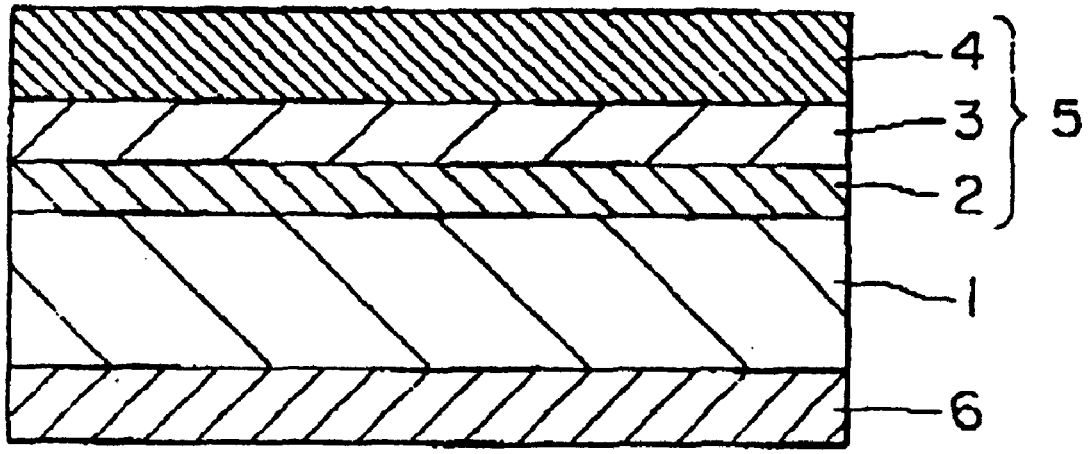
FIG. 2 is an explanatory, schematic cross-sectional view of another embodiment of the thermal transfer sheet according to the present invention.

The present invention will be described in more detail with reference to the accompanying drawings diagrammatically showing preferred embodiments of the present invention. FIGS. 1 and 2 are explanatory, schematic cross-sectional views of embodiments of the thermal transfer sheet according to the present invention.

FIG. 1 shows an embodiment, of the thermal transfer sheet of the present invention, having the most typical layer construction, and the thermal transfer sheet comprises a substrate film 1 and a release layer 2, a protective layer 3, and a hot-melt ink layer 4 provided in that order on one side of the substrate film 1. In this case, the release layer 2, the protective layer 3, and the hot-melt ink layer 4 constituting a thermal transfer layer 5.

FIG. 2 shows another embodiment of the thermal transfer sheet according to the present invention, comprising: a substrate film 1; a release layer 2, a protective layer 3, and a hot-melt ink layer 4 provided in that order on one side of the substrate film 1 (the release layer 2, the protective layer 3, and the hot-melt ink layer 4 constituting a thermal transfer layer 5: and a backside layer 6 provided on the other side of the substrate film 1.

Materials for constituting the thermal transfer sheet of the present invention and a process for producing the thermal transfer sheet of the present invention will be described. At the outset, the substrate film will be described.

Substrate film

The substrate film used in the thermal transfer sheet of the present invention is not particularly limited. Specifically, substrate films used in the conventional thermal transfer sheet as such may be used in the present invention. Specific preferred examples of the substrate film include: films of plastics, for example, polyesters, including polyethylene terephthalate, polycarbonate, polyamide, polyimide, cellulose acetate, polyvinylidene chloride, polyvinyl chloride, polystyrene, fluororesin, polypropylene, polyethylene, and ionomers; papers such as glassine paper, condenser paper, and paraffin paper; and cellophane. Further, a composite substrate film formed by laminating two or more of these films on top of the other or one another may also be used. The thickness of the substrate film may be varied depending upon the material so as to have suitable strength and heat resistance. In general, for example, it is preferably about 3 to 100 $\mu$m.

Release layer

The release layer 2 is provided from the viewpoint of improving the releasability of the protective layer 3 from the substrate film 1 at the time of thermal transfer. At the time of thermal transfer, the protective layer 3 is separated from the release layer or alternatively is separated together with the release layer from the substrate film. The release layer 2 may be formed by coating a coating liquid, containing at least one member selected from waxes, such as carnauba wax, paraffin wax, microcrystalline wax, and silicone wax, and resins, such as silicone resin, fluororesin, acrylic resin, polyvinyl alcohol resin, cellulose derivative resin, urethane resin, vinyl acetate resin, (meth)acrylate/vinyl ether resin, and maleic anhydride resin, by a conventional coating method, such as gravure coating or gravure reverse coating, and drying the coating. Among them, waxes are preferred with carnauba wax having high scratch resistance being particularly preferred. The thickness of the coating after drying is preferably about 0.3 to 1.0 μm. When the thickness is not less than 0.3 μm, the releasability is deteriorated, making it impossible to attain the contemplated effect of the release layer. On the other hand, when it is more than 1.0 μm, the transfer of the release layer per se is likely to occur. Since the release layer per se has scratch resistance, the transfer of the release layer per se poses no problem. However, an excessively high thickness of the release layer has disadvantages including that the cost is increased, the transferability of the protective layer together with the release layer is deteriorated, and/or the capability of the thermal transfer layer to be held is deteriorated.

Protective layer

The protective layer 3 is provided for the purpose of attaining a main object of the present invention, that is, improving the scratch resistance and heat resistance of the thermal transfer layer. It nay be formed by coating a coating liquid, containing at least resin selected from polymethyl methacrylate resin, cellulose derivatives, and chlorinated polypropylene, by a conventional coating method, such as gravure coating or gravure reverse coating, and drying the coating. Among the above resins, polymethyl methacrylate resin is preferred because it has high scratch resistance and heat resistance. The thickness of the coating after drying is about 0.5 μm, preferably about 0.3 to 1.0 μm. When the thickness is less than 0.3 μm, the scratch resistance and the heat resistance are deteriorated, while when it exceeds 1.0 μm, the protective layer becomes rigid, unfavorably resulting in deteriorated flexibility of the thermal transfer sheet.

Hot-melt ink layer

The hot-melt ink layer 4 is formed of a mixture of a colorant with a binder resin. Resins usable herein include resins having a heat softening temperature of 60 to 110° C., such as phenolic resins, alkylphenolic resins, allylphenolic resins, epoxy resins, rosins, rosin ester resins, hydrogenated rosins, and hydrocarbon resins. Among them, novolac type phenol/formaldehyde polycondensate is preferred. Regarding colorants usable in the present invention, a suitable colorant may be selected, depending upon required color tone or the like, from carbon black, inorganic pigments, organic pigments, and dyes. The mixing weight of the colorant to the resin is not particularly limited. Preferably, however, the mixing weight ratio of the novolac phenol/formaldehyde polycondensate to the colorant is 4:1 to 2:3.

The hot-melt ink layer may be formed by coating a coating liquid, in the form of a dispersion or solution of the above materials in an organic solvent or the like, on the protective layer by a conventional coating method, such as gravure coating or gravure reverse coating and drying the coating. Thickness of the hot-melt ink layer after drying is about 1.0 μm, preferably about 0.8 to 3.0 μm. When the thickness is less than 0.8 μm, the density of the transferred image is low, while when it exceeds 3.0 μm, the hot meltability of the coating is deteriorated, unfavorably making it difficult to conduct the thermal transfer of the coating.

Backside layer

In the thermal transfer sheet according to the present invention, if necessary, a backside layer 6 (a heat-resistant slip layer) may be provided on the surface of the substrate film remote from the thermal transfer layer 5 from the viewpoint of preventing blocking between the thermal transfer sheet and a thermal head, a hot plate for thermal transfer and the like and, at the same time, of improving the slip property of the thermal transfer sheet. A conventional resin, such as a resin, prepared by curing a butyral resin or the like with an isocyanate compound, or a silicone resin as such may be used as the material for the backside layer 6. The thickness of the backside layer is preferably about 0.1 to 5 μm. If necessary, the backside layer may be provided through a primer layer.

The following examples further illustrate the present invention but are not intended to limit it. In the following examples and comparative examples, all "%" are by weight unless otherwise specified.

EXAMPLE 1

A 6 μm-thick biaxially stretched polyethylene terephthalate film (hereinafter referred to as "PET") (trade name: Lumirror, manufactured by Toray Industries, Inc.) was provided as a substrate film. A 1 μm-thick heat-resistant slip layer of a silicone resin was provided as a backside layer by gravure printing on the whole area of one side of the substrate film. A coating liquid, for a release layer, having the following composition was then coated at a coverage of 0.5 g/$^2$ on a dry basis by gravure printing on the other side of the substrate film, and the coating was dried to form a release layer. A coating liquid, for a protective layer, having the following composition was then coated at a coverage of 0.5 g/m$^2$ on a dry basis by gravure printing on the release layer, and the coating was dried to form a protective layer. Finally, a coating liquid, for a hot-melt ink layer, having the following composition was coated at a coverage of 1.0 g/m$^2$ on a dry basis by gravure printing on the protective layer, and the coating was dried to form a hot-melt ink layer.

| Composition of coating liquid for release layer | |
|---|---|
| Carnauba emulsion (solid content 40%) (trade name: WE-95, manufactured by Konishi Co., Ltd.) | 50% |
| Isopropyl alcohol (hereinafter referred to as "IPA") | 25% |
| Water | 25% |

| Composition of coating liquid for protective layer | |
|---|---|
| Polymethyl methacrylate (hereinafter referred to as "PMMA") (average molecular weight 45000, Tg 105° C.) | 30% |
| Toluene | 30% |
| Methyl ethyl ketone (hereinafter referred to as "MEK") | 40% |

| Composition of coating liquid for hot-melt ink layer | |
|---|---|
| Novolac phenol/formaldehyde polycondensate (softening point 90° C.) (trade name: Tamanol PA, manufactured by Arakawa Chemical Industries, Ltd.) | 15% |
| Carbon black | 15% |
| MEK | 70% |

EXAMPLE 2

A thermal transfer sheet was prepared in the same manner as in Example 1, except that the coating liquid for a hot-melt ink layer had the following composition and the coverage of the hot-melt ink layer was 1.0 g/m$^2$.

| Composition of coating liquid for hot-melt ink layer | |
|---|---|
| Novolac phenol/formaldehyde polycondensate (softening point 90° C.) (trade name: Tamanol PA, muanufactured by Arakawa Chemical Industries, Ltd.) | 21% |
| Carbon black | 9% |
| MEK | 70% |

EXAMPLE 3

A thermal transfer sheet was prepared in the same manner as in Example 1, except that the coating liquid for a hot-melt ink layer had the following composition and the coverage of the hot-melt ink layer was 1.0 g/m$^2$.

| Composition of coating liquid for hot-melt ink layer | |
|---|---|
| Novolac phenol/formaldehyde polycondensate (softening point 120° C.) (trade name: Vircum TD-2090, manufactured by Dainippon Ink and Chemicals, Inc.) | 15% |
| Carbon black | 15% |
| MEK | 70% |

EXAMPLE 4

A thermal transfer sheet was prepared in the same manner as in Example 1, except that the coating liquid for a protective layer had the following composition and the coverage on a dry basis of the protective layer was 0.5 g/m$^2$.

| Composition of coating liquid for protective layer | |
|---|---|
| Chlorinated polypropylene (manufactured by Showa Ink Ind. Co., Ltd.) | 30% |
| Toluene | 40% |
| MEK | 30% |

COMPARATIVE EXAMPLE 1

A thermal transfer sheet was prepared in the same manner as in Example 1, except that the hot-melt ink layer was provided directly on the PET filt.

COMPARATIVE EXAMPLE 2

A thermal transfer sheet was prepared in the same manner as in Example 1, except that the provision of the protective layer was omitted.

COMPARATIVE EXAMPLE 3

A thermal transfer sheet was prepared in the same manner as in Example 1, except that the provision of the release layer was omitted.

<Evaluation>

Printing was conducted by means of the following printer using the thermal transfer sheets prepared in the examples and the comparative examples, and the prints thus obtained were evaluated for the sensitivity in printing, the heat resistance, and the scratch resistance. The results are summarized in Table 1.

Sensitivity in printing

Thermal transfer printer: BC-8 MK2, manufactured by Auto Nics Co., Ltd.

Printing conditions

Density; HDPA

Label

125-$\mu$m white PET

Evaluation criteria (visual inspection):

O: Good transfer of ink layer x: Unsatisfactory transfer of ink layer

Scratch resistance

Tester: HEIDON-14, manufactured by Shinto Scientific Company Ltd.

Load; 200 g

Speed: 6000 mm/min

Number of reciprocations; 20

Evaluation criteria: Evaluated in terms of percentage error element as measured with AUTO SCAN, manufactured by RJS ENTERPRISES INC.

Heat resistance

Tester: TP-701S Heat Seal Tester, manufactured by Tester Sangyo Co., Ltd.

Pressure: 3.5 kg/cm$^2$

Temp.: 180° C.

Time: 10 sec

Counter cloth: shirting No. 3

Evaluation criteria (visual inspection);

O: The print not transferred onto the cloth.

x: The print transferred onto the cloth.

TABLE 1

| | Sensitivity in printing | Heat resistance | Scratch resistance |
|---|---|---|---|
| Example 1 | ○ | ○ | 0% |
| Example 2 | ○ | ○ | 0% |
| Example 3 | ○ | ○ | 0% |
| Example 4 | ○ | ○ | 0% |
| Comparative Example 1 | x | — | — |
| Comparative Example 2 | ○ | x | 20% |
| Comparative Example 3 | x | ○ | 8% |

What is claimed is:

1. A label comprising an untreated PET substrate film wherein:

an image is provided on the untreated PET substrate film, the image having been transferred from a thermal transfer sheet; and said thermal transfer sheet comprising a substrate film layer; and a release layer, a protective layer, and a hot-melt ink layer provided in that order on one side of said substrate film layer of said thermal transfer sheet, wherein said release layer is formed of a wax, said protective layer is formed of a polymethyl methacrylate resin, and said hot-melt ink layer is formed of a mixture of a novolac phenol/formaldehyde polycondensate with a colorant.

2. The label of claim 1, wherein the weight ratio of the novolac phenol/formaldehyde polycondensate to the colorant in the hot-melt ink layer is 4:1 to 2:3.

* * * * *